United States Patent [19]

Oen

[11] Patent Number: 4,658,470

[45] Date of Patent: Apr. 21, 1987

[54] ADJUSTABLE HOOD HINGE ASSEMBLY

[75] Inventor: Joshua T. Oen, Castro Valley, Calif.

[73] Assignee: Paccar, Inc., Bellevue, Wash.

[21] Appl. No.: 788,647

[22] Filed: Oct. 17, 1985

[51] Int. Cl.[4] ..... E05D 7/06

[52] U.S. Cl. ..... 16/241; 16/245; 180/69.21

[58] Field of Search ..... 16/241, 245, 246, 242, 16/238, 382, DIG. 39; 180/69.21, 89.16

[56] References Cited

U.S. PATENT DOCUMENTS

| | | | |
|---|---|---|---|
| 2,204,990 | 6/1940 | Haltenberger . | |
| 2,781,102 | 2/1957 | Prichard | 180/69.21 |
| 3,017,944 | 1/1962 | Norrie | 180/69.21 |
| 3,092,097 | 6/1963 | Moss | 16/245 |
| 3,114,942 | 12/1963 | Abedon et al. . | |
| 3,171,156 | 3/1965 | Peras . | |
| 3,758,919 | 9/1973 | Dilworth, Jr. . | |
| 4,490,883 | 1/1985 | Gauron | 16/245 |

*Primary Examiner*—Leonidas Vlachos

*Attorney, Agent, or Firm*—Flehr, Hohbach, Test, Albritton & Herbert

[57] ABSTRACT

The vehicle, specifically a truck, having a tilt-forward hood is disclosed herein along with a pair of hinges mechanisms for pivotally connecting the hood to the front end section of the vehicle's main body for movement between a completely closed position and a fully opened position. Each hinge mechanism includes a main assembly movable between various adjustable positions for adjusting the position of the hood with respect to the vehicle's main body when the hood is in its closed position and a manually engagable member for moving the main assembly between its various adjustable positions in order to adjust the position of the hood. The main arrangement is located entirely under the hood when the latter is closed, whereby to hide it from view from outside the vehicle. At the same time, the manually engagable member is readily accessible from outside the vehicle when the hood is closed, whereby the hood can be adjusted without its having to be opened.

1 Claim, 4 Drawing Figures

ADJUSTABLE HOOD HINGE ASSEMBLY

The present invention relates generally to a mechanical arrangement for interconnecting a vehicle's hood to the rest of the vehicle and more particularly to a specifically designed adjustable hinge mechanism for use with a tilt-forward vehicle hood.

A tilt-forward hood on a vehicle is one which has its forward-most end pivotally connected with the front end section of the vehicle's main body for movement between a completely closed position and a fully opened position. Most trucks which include tilt-forward hoods support the latter either by means of concealed hinges or exposed hinges. Concealed hinges are those which cannot be seen from outside the vehicle when the hood is closed while exposed hinges are mounted entirely outside the vehicle. In each case, the hinge includes a mechanism which allows the hood to be adjusted with respect to the vehicle's main body when the hood is closed in order to correct for periodic misalignments between the two. Both of these approaches, that is, the use of concealed and exposed hinges, have advantages and disadvantages over one another, as will be discussed below.

While the exposed hinge is readily accessible when the hood is closed in order to adjust the latter, its external appearance may be unsightly, unless steps are taken to design the vehicle's exterior styling so that the hinge blends in with it. This is not always possible. The concealed hinge, on the other hand, is not a factor in styling the exterior of the vehicle. However, it has been found to be difficult to adjust the hood when concealed hinges are used. This is because the hood must be open to gain access to the adjustment mechanism forming part of the hinge so that the amount of adjustment necessary to properly align the hood is in large part guess work. In many cases, the hood must be opened, adjusted and closed a number of times before it is properly aligned. It is easy to see that this can be a tedious process if the hood is initially out of alignment a substantial amount.

In view of the foregoing, it is a primary object of the present invention to provide a hinge mechanism which combines the aesthetic advantages of an internal hinge mechanism and the adjustment advantages of one which is externally mounted.

As will be seen hereinafter, the hinge mechanism disclosed herein includes a first means or main assembly movable between various adjustable positions for adjusting the position of the hood with respect to the vehicle's main body and a second means for moving the first means between its various adjustable positions. The first means or main assembly is located entirely under the vehicle's hood when the latter is in its closed position and therefore hidden from view from outside the vehicle. At the same time, the second means is readily accessible from outside the vehicle when the hood is closed, whereby the hood can be adjusted without its having to be opened.

This overall mechanism will be described in more detail hereinafter in conjunction with the drawings wherein.

Figure 1:
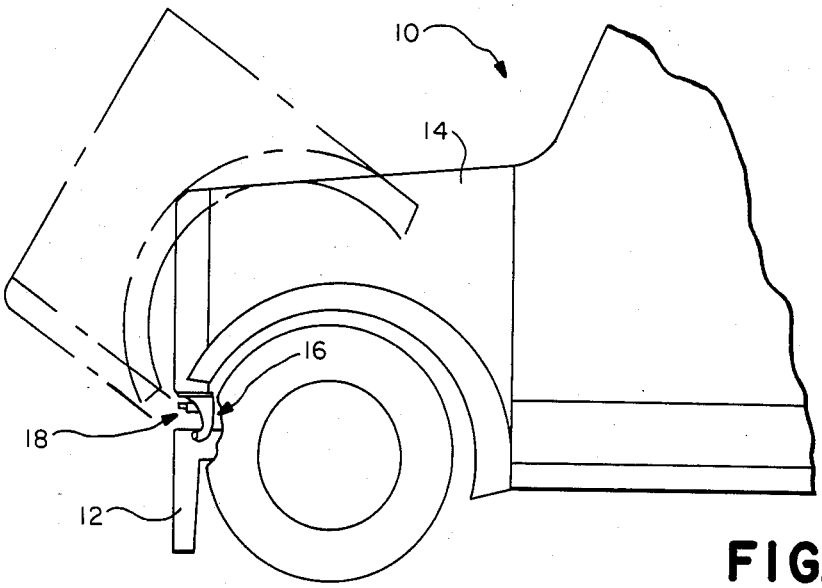
FIG. 1 is a side elevational view of the front end of a vehicle, specifically a truck, having a tilt-forward hood and a pair of adjustable hinge mechanisms designed in accordance with the present invention.

Turning now to the drawings, wherein like components are designed by like reference numerals throughout the three figures, attention is first directed to FIG. 1. This figure illustrates a truck generally indicated at 10 having a main body including but not limited to a front bumper assembly 12 and also having a tilt-forward hood 14. A pair of hinge mechanisms designed in accordance with the present invention are utilized in connecting hood 14 to the vehicle chassis generally indicated at 15 (see FIGS. 3A and 3B) for movement between the completely enclosed position indicated by solid lines in FIG. 1 and the entirely opened position indicated by dotted lines. One of the hinge mechanisms is illustrated in FIG. 1 at 16 while the other, which is laterally spaced from the hinge shown, is hidden from view. The two having mechanisms together define the pivot axis for hood 14 and, as will be seen hereinafter, serve to adjust the position of the hood with respect to the vehicle's main body when the hood is closed.

As will also be seen, each hinge mechanism 16 includes a main assembly located entirely under the hood when the latter is closed, and therefore hidden from view, and means readily accessible from outside the vehicle, again when the hood is closed, in order to make the adjustments needed to properly align the hood with respect to the rest of the vehicle. This is accomplished by providing this latter means forming part of each hinge mechanism in a space 18 between bumper assembly 12 and the forward lower-most end of the hood, as illustrated in FIG. 1.

Figure 2:
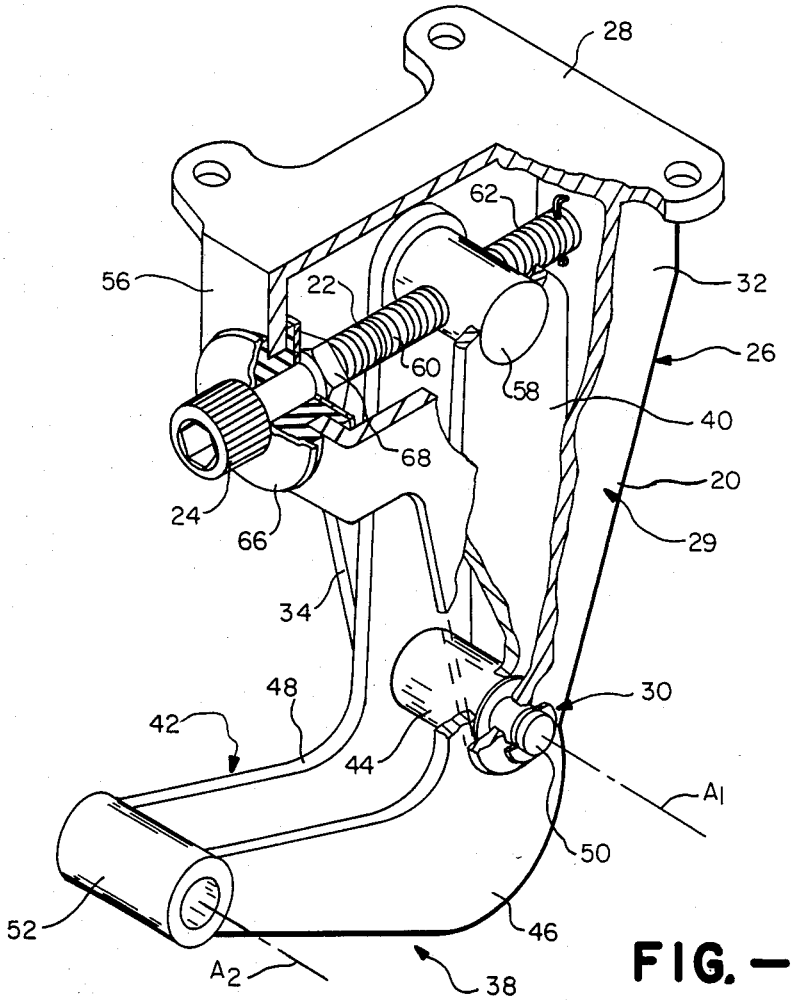
FIG. 2 is a partially broken-away perspective view of one of the hinge mechanisms designed in accordance with the present invention.

Turning now to FIG. 2, attention is directed to one of the mechanisms 16 which is shown including a main assembly 20 located under hood 14 when the latter is closed, as stated above, and an adjustment bolt 22 having a manually engagable knob 24 which is disposed at one end thereof and located in space 18. As will be seen below, the main assembly 20 connects hood 14 to the vehicle chassis 15 for the previously described pivotal movement between the hood's opened and closed positions. At the same time, the main assembly 20 is itself movable between various adjustable positions for adjusting the position of the hood with respect to the chassis 15 and the rest of the vehicle generally. As will also be seen, the adjustment bolt 22 serves to move the main assembly 20 between its various adjustable positions in order to adjust the position of the hood. This is accomplished by manipulating (rotating) knob 22 manually, that is, by hand or by use of a hex wrench or the like. Since the knob 24 is readily accessible from outside the vehicle 10 when hood 14 is closed, this adjustment can be made with the hood closed. At the same time, because main assembly 20 is located entirely under the hood when the latter is closed, it does not affect the external appearance of vehicle 10.

Still referring to FIG. 2, main assembly 20 includes a first upper member 26 including an upwardly facing mounting base 28 fixedly connected by bolts or other suitable means to the underside of hood 14, as best illustrated in FIG. 3, and a downwardly depending pivot arm support section 29. As best illustrated in FIG. 3 in conjunction with FIG. 2, support section 29 tapers inwardly as it extends downwardly from mounting base 28 and carries at its bottom end a pivot arrangement 30 to be described hereinafter. This pivot arrangement extends from one side wall 32 of the support section 29 to an opposite side wall 34 which is laterally spaced from side wall 32 in order to define a channel or opening 36 therebetween.

Main assembly 20 also includes a second, lower member 38 in the form of a generally L-shaped pivot arm including a vertically extending section 40 and a horizontally extending section 42. With section 40 disposed within channel or opening 36 of upper member 26, the entire support arm and upper member 26 are pivotally connected to one another by means of pivot arrangement 30. This arrangement includes an outer bearing sleeve 44 carried by and between laterally spaced side walls 46 and 48 forming opposite sides of pivot arm 38 and a pin bearing 50 supported by the side walls 32 and 34 of member 29 and extending through the bearing sleeve 44. As a result, the upper member 26 and lower pivot arm 38 of main assembly 20 are pivotally movable relative to one another about a horizontally extending axis A1 shown by dotted line in FIG. 2.

The free end of horizontal section 42 of the pivot arm 38 is shown carrying its own bearing sleeve 52. This bearing sleeve and a corresponding sleeve forming part of the other mechanism 16 are pivotally connected with cooperating pin bearings (not shown) forming part of the vehicle chassis 15 so as to be pivotal about a common axis A2 which is the axis of pivotal movement of hood 14. In other words, the entire main assembly which is fixedly connected to hood 14 by mounting base 28 is mounted to the vehicle chassis 15 for pivotal movement about axis A2 and therefore supports the hood for pivotal movement about the same axis. For reasons to be discussed hereinafter, it should be kept in mind that bearing sleeve 52 forming part of each mechanism 16 is movable only rotationally about axis A2.

As will be seen below, adjustment bolt 22 is provided for rotating member 26 and pivot arm 38 relative to one another when hood 14 is closed in a way which causes the main assembly to adjust the position of the hood relative to the chassis 15 and the rest of the vehicle in general. In this regard, it should be noted that upper member 26 includes a front face 56. At the same time, the vertically extending section 40 of pivot arm 38 carries a horizontally extending sleeve 58. Adjustment bolt 22 includes a shaft 60 extending through a cooperating opening in front face 56 of member 26 and a threaded section 62 which is thread-connected through an internally threaded cooperating opening in sleeve 58. The entire adjustment bolt is mounted in this position for rotation about its own axis while it is fixedly retained axially relative to face 56 by knob 24 and a locknut 68. In other words, the entire bolt may be rotated about its own axis by rotating knob 24 while, at the same time, the bolt cannot move axially. Because the bolt does not move axially, when it is rotated, sleeve 58 is caused to move along threaded section 62, either towards or away from locknut 68, depending upon which way the bolt is rotated. As will be seen hereinafter, this relative movement between the bolt and sleeve 58 causes upper member 26 and pivot arm 38 to pivotally move relative to one another and relative to the vehicle chassis 15 about axes A1 and A2 in a way which adjusts the position of hood 14.

Figure 3A:
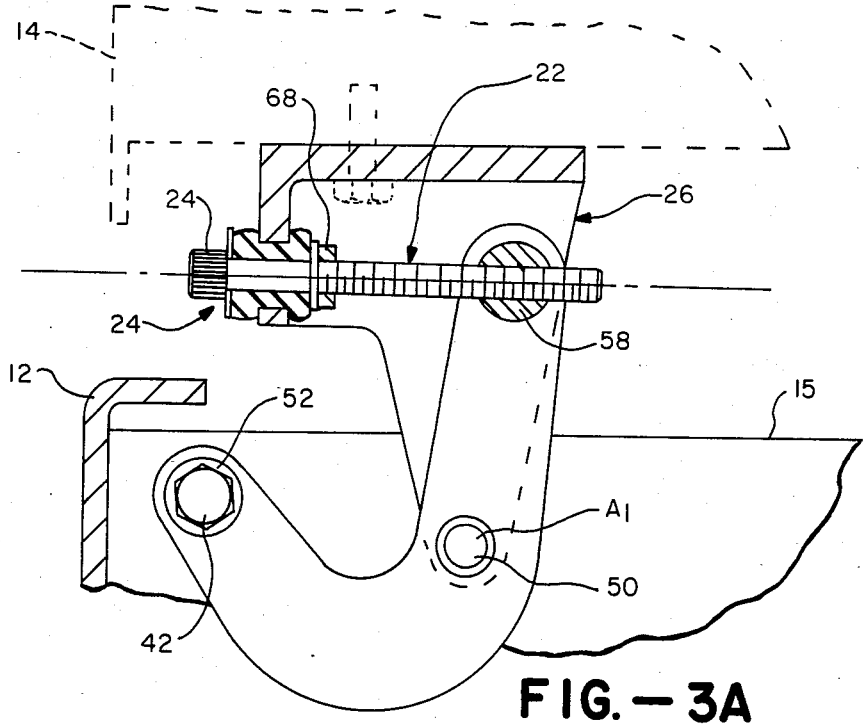
FIGS. 3A and B are side elevational views of the hinge mechanism of FIG. 2 shown in different adjustable positions connecting the hood of the vehicle illustrated in FIG. 1 with the vehicle's main body.
Figure 3B:
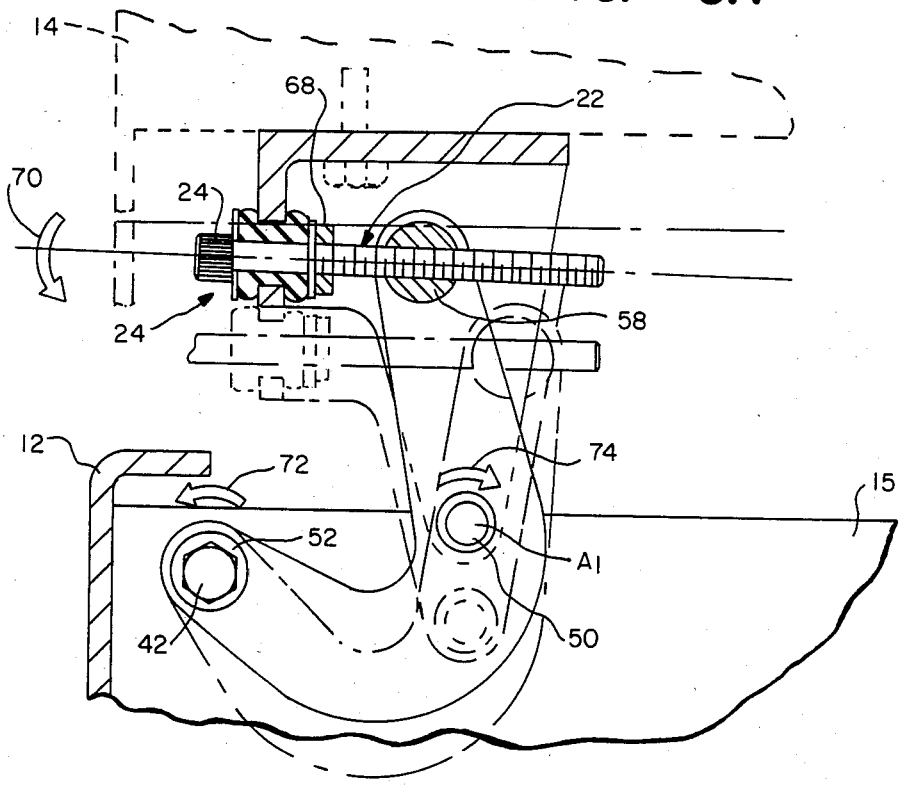

Referring now to FIGS. 3A and 3B, attention is directed to the way in which rotation of knob 24 adjusts the position of hood 14 relative to the rest of the vehicle. At the outset, assume that hood 14 is closed and that the hood and mechanism are in the positions illustrated in FIG. 3A. The chassis 15 never moves and therefore will serve as a frame of reference. The mounting base 28 which is fixedly connected to the underside of the hood is shown at a particular position relative to chassis 15. Keeping in mind that bearing sleeve 52 is only capable of pivoting about axis A2, when adjustment bolt 22 is rotated about its own axis, for example in the direction indicated by arrow 70 in FIG. 3B, the lower member 38 is caused to pivot a corresponding amount about the A2 axis, as indicated by arrow 72 in FIG. 3B. At the same time, the entire upper member 26 including mounting base 28 and the bolt 22 pivot about axis A1 relative to pivot arm 38 a corresponding amount, as indicated by arrow 74. As a result of these two different movements, that is, the pivotal movement of the pivot arm 38 about axis A2 and the pivotal movement of the upper member 26 and the adjustment bolt about axis A1 relative to the pivot arm, the entire main assembly 20 shifts upward from its dotted line position in FIG. 3B (corresponding to FIG. A) to its solid line position illustrated in FIG. 3B. This shifts mounting base 28 upward from its dotted line position in FIG. 3B to its solid line position and therefore the entire hood is shifted upward with the mounting base.

By rotating the adjustment bolt in the opposite direction, the hood can be shifted downward from its solid line position. Moreover, depending upon the amount and direction of rotation of the adjustment bolt, the hood can be adjustably moved to various positions upward and downward from the solid line position illustrated. Note that this is accomplished from outside the vehicle while the hood remains closed and main assembly 20 remains under the hood.

Only one of the two mechanisms 16 has been described. It is to be understood that both mechanisms may be identical and each may be adjusted in the manner described above. Moreover, the vehicle 10 may include more than two such mechanisms. Also, in order to isolate knob 24 forming part of adjustment bolt 22 from vibrations of the vehicle, generally an elastic grommet 66 can be provided around the adjustment bolt between knob 24 and locking nut 68.

What is claimed is:

1. In a vehicle having a main body including a front end section and a hood pivotally connected at its front end with the front end section of said main body for movement between a completely closed position and a fully opened position, the improvement comprising:

(a) first means connected with said front end section and said hood of said vehicle body and movable between various adjustable positions for adjusting the position of said hood with respect to the front end of said main body when the hood is in its closed position, said first means being located entirely under said hood when the latter is in its closed position, whereby to hide said first means from view from outside the vehicle, said first means including a first member fixedly connected to said hood for movement with the latter between its opened and closed positions and a second member pivotally connected at one point to said first member and at a second point to said front end section of said main body; and (b) second means connected with said first means for moving said first means between its various adjustable positions in order to adjust the position of said hood, said second means being accessible from outside the vehicle when the hood is in its closed position, whereby the hood can be adjusted without its having to be opened, said second means including means for pivotally moving said first and second members relative to one another about a first axis through said first point and for pivotally moving both of said members about a second axis through said second point in order to cause the overall first means to move between its various adjustable positions, said means for pivotally moving said members including manually engagable means rotatably mounted on said first member and located outside the vehicle when said hood is in its closed position for pivotally moving said members between said various positions and an adjustment bolt connected to said manually engageable means, mounted for rotation about its own axis and threadedly connected to said second member such that rotation of the bolt about its axis in one direction or the other moves said first means between said various positions and wherein said manually engagable means includes a knob connected to said bolt, the rotation of said bolt by said knob causing said first member to pivot about said first axis and both of said members to pivot about said second axis in order to cause the overall first means to move between its various positions.

* * * * *